US008994275B2

(12) United States Patent
Wang

(10) Patent No.: US 8,994,275 B2
(45) Date of Patent: Mar. 31, 2015

(54) NON-CONTACT AND NON-DISPOSABLE ELECTRIC INDUCTION LED LAMP

(71) Applicant: Ceramate Technical Co., Ltd., Taoyuan County (TW)

(72) Inventor: Robert Wang, Taoyuan County (TW)

(73) Assignee: Ceramate Technical Co., Ltd., Taoyuan County (TW)

( * ) Notice: Subject to any disclaimer, the term of this patent is extended or adjusted under 35 U.S.C. 154(b) by 51 days.

(21) Appl. No.: 13/752,492

(22) Filed: Jan. 29, 2013

(65) Prior Publication Data

US 2014/0210341 A1 Jul. 31, 2014

(51) Int. Cl.

| | |
|---|---|
| ***H05B 37/00*** | (2006.01) |
| ***H05B 41/00*** | (2006.01) |
| ***H05B 41/14*** | (2006.01) |
| ***H05B 33/08*** | (2006.01) |

(52) U.S. Cl.

CPC ..... *H05B 33/0803* (2013.01); *H05B 33/0815* (2013.01)

USPC ..... 315/127; 314/15; 315/120

(58) Field of Classification Search

CPC ..... H05B 41/2855; H05B 41/2851; H05B 41/46; H05B 33/0803; B23H 1/024; B23H 1/026; H02H 7/127; B23K 9/1031

USPC ..... 315/127, 120, 121, 123–125; 314/15

See application file for complete search history.

(56) References Cited

U.S. PATENT DOCUMENTS

| | | | | |
|---|---|---|---|---|
| 6,124,679 | A * | 9/2000 | Vrionis | 315/248 |
| 2009/0303735 | A1* | 12/2009 | Chen | 362/373 |
| 2011/0291570 | A1* | 12/2011 | Sinai et al. | 315/149 |
| 2013/0043833 | A1* | 2/2013 | Katz et al. | 320/108 |
| 2013/0058101 | A1* | 3/2013 | Wang | 362/296.01 |
| 2014/0028210 | A1* | 1/2014 | Maxik et al. | 315/200 R |

* cited by examiner

*Primary Examiner* — Dylan White

(74) *Attorney, Agent, or Firm* — Ming Chow; Sinorica, LLC

(57) ABSTRACT

A non-contact and non-disposable electric induction LED lamp includes a power source and a luminous-radiating unit combined together. The power source is formed with a power source module electrically connected with a first electric induction plate, while the luminous-radiating unit is provided with a second electric induction plate corresponding with the first electric induction plate and electrically connected with an LED module. Thus, the electricity of the power source can be transmitted to the luminous-radiating unit via electromagnetic induction produced between the first and the second electric induction plates to enable the LED module to emit light. The LED lamp of this invention can partially be replaced conveniently and has water proof and dustproof effects.

4 Claims, 7 Drawing Sheets

NON-CONTACT AND NON-DISPOSABLE ELECTRIC INDUCTION LED LAMP

BACKGROUND OF THE INVENTION

1. Field of the Invention

This invention relates to a non-contact and non-disposable electric induction LED lamp.

2. Description of the Prior Art

The inventor of this invention previously devised various kinds of non-disposable LED lamps for improving the drawbacks of a conventional LED lamp that a whole set of the conventional LED lamp must be eliminated and replaced with a new one so long as a certain component of the LED lamp is damaged. An electric bulb-shaped non-disposable LED lamp, as shown in FIG. 1, includes a base 1 provided thereon with a power module 2 connected with a first connector 3. A luminous module 4 is assembled on the base 1 and provided with a second connector 5 to be assembled with the first connector 3, and the second connector 5 is connected with an LED circuit board 6. By so designing, only the base 1 or the luminous module 4 needs to be replaced singly in accordance with the location where the component is damaged. For instance, when the LED circuit board 6 is damaged, only the luminous module 4 needs to be replaced, unnecessary to eliminate and replace a whole set of the non-disposable LED lamp, thus attaining effects of lowering selling price, elevating economic value and environmental protection.

Although foresaid non-disposable LED lamps are widely known and greatly loved by consumers after being launched to the markets, yet the inventor of this invention found that since the power module 2 is to have electricity transmitted to the luminous module 4 via the this first connector 3 and the second connector 5 that are combined together; therefore, water vapor and dust are apt to get into the power module 2 along the first connector 3 and also into the luminous module 4 along the second connector 5, thus shortening service life of both the power module 2 and luminous module 4. In addition, to replace the base 1 or the luminous module 4 and recombine them together, a user has to make the first connector 3 aligned to the second connector 5, resulting in much inconvenience. Therefore, finding the defects of foresaid non-disposable LED lamp and adhering to the spirit of endeavoring to do everything better, the inventor of this invention think that it is really necessary to ameliorate the conventional non-disposable LED lamp.

SUMMARY OF THE INVENTION

The objective of this invention is to offer a non-contact and non-disposable electric induction LED lamp, able to have the electricity of a power source transmitted to a luminous-radiating unit in a non-contact mode to enable an LED module of the luminous-radiating unit to emit light.

The non-contact and non-disposable electric induction LED lamp in the present invention includes a power source and a luminous-radiating unit. The power source is formed with a power source module electrically connected with a first electric induction plate. The luminous-radiating unit to be combined and fixed together with the power source is provided with a second electric induction plate corresponding with the first electric induction plate and electrically connected with an LED module.

The non-contact and non-disposable electric induction LED lamp of this invention is to have the electricity of the power source transmitted to the luminous-radiating unit via electromagnetic induction produced between the first and the second electric induction plates, that is, transmission of electricity is carried out in a non-contact mode. Therefore, no outer metallic contact needs to be provided and hence, the power source and the luminous-radiating unit can be sealed completely, attaining waterproof and dustproof effects, facilitating the LED lamp to be partially replaced and reducing electronic waste.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
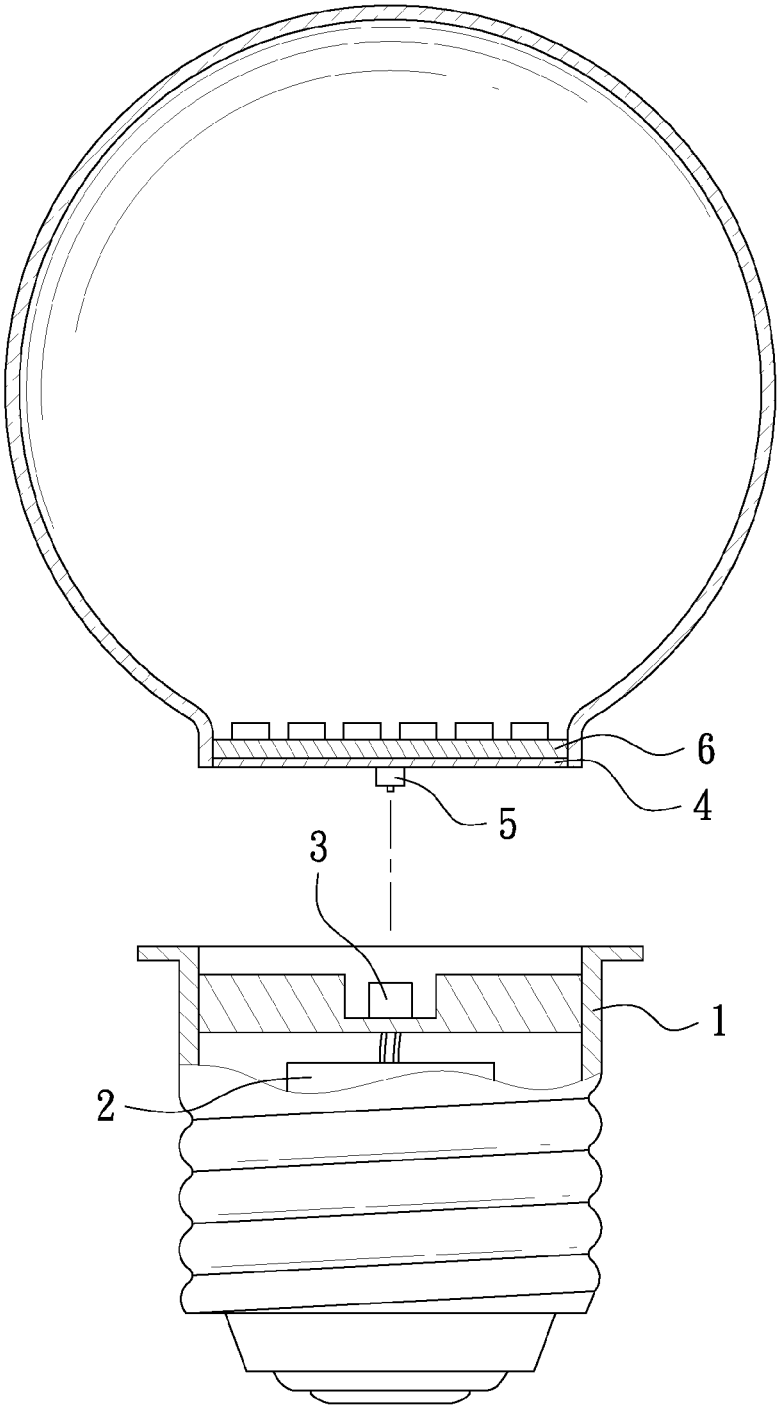
FIG. 1 PRIOR ART
FIG. 1 is a schematic view of a conventional non-disposable LED lamp.
Figure 2:
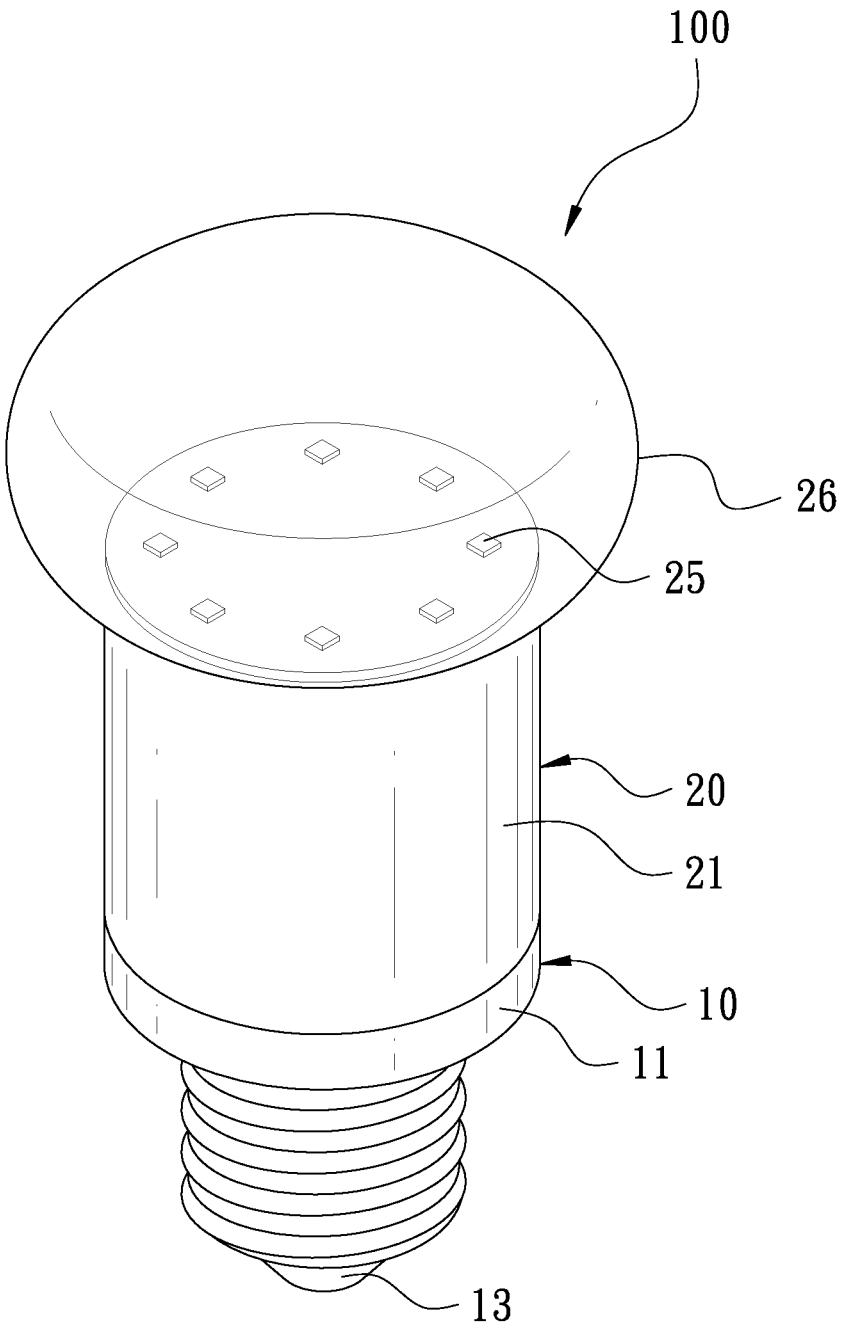
FIG. 2 is a perspective view of a first preferred embodiment of a non-contact and non-disposable electric induction LED lamp in the present invention.
Figure 3:
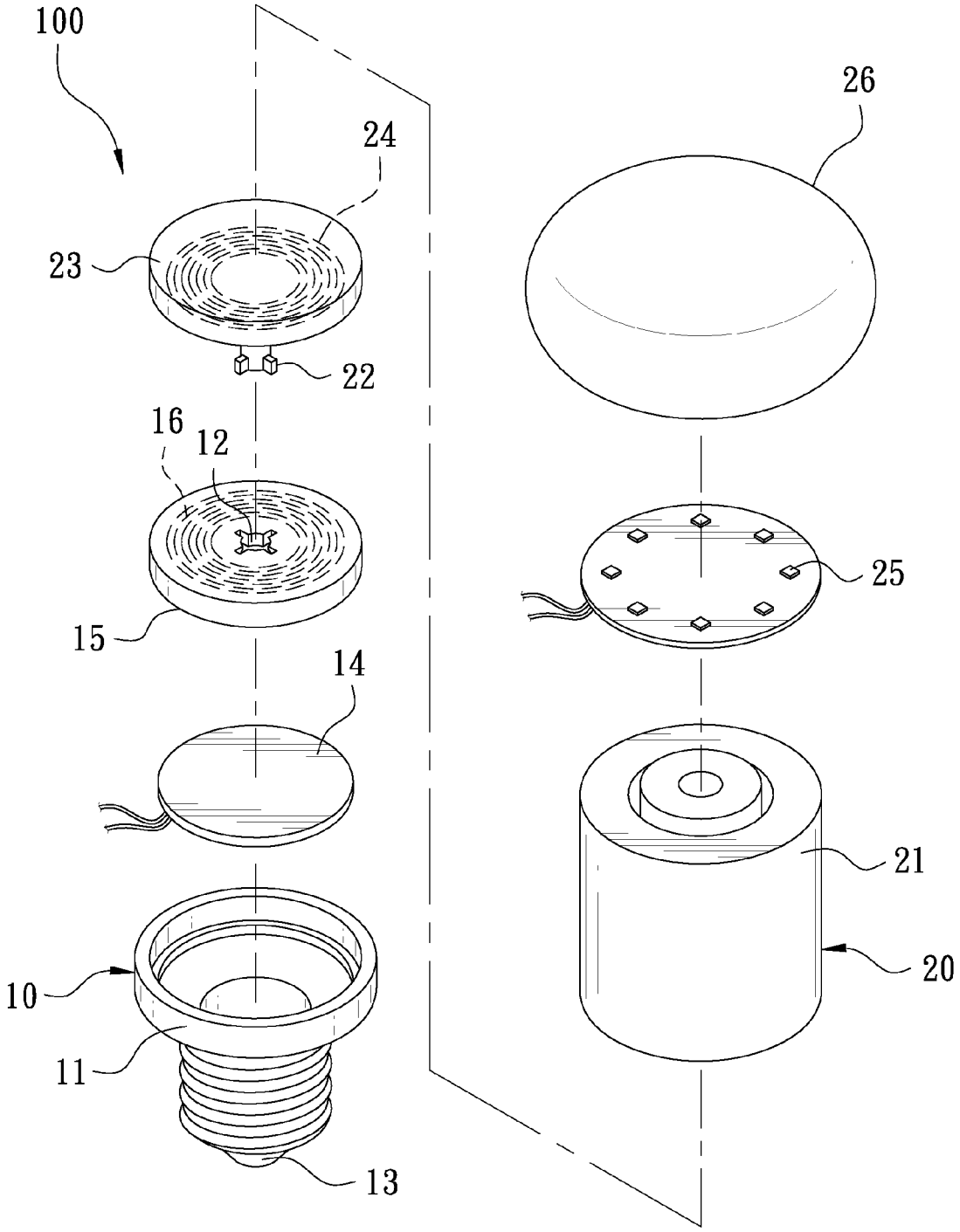
FIG. 3 is an exploded perspective view of the first preferred embodiment of the non-contact and non-disposable electric induction LED lamp in the present invention.
Figure 4:
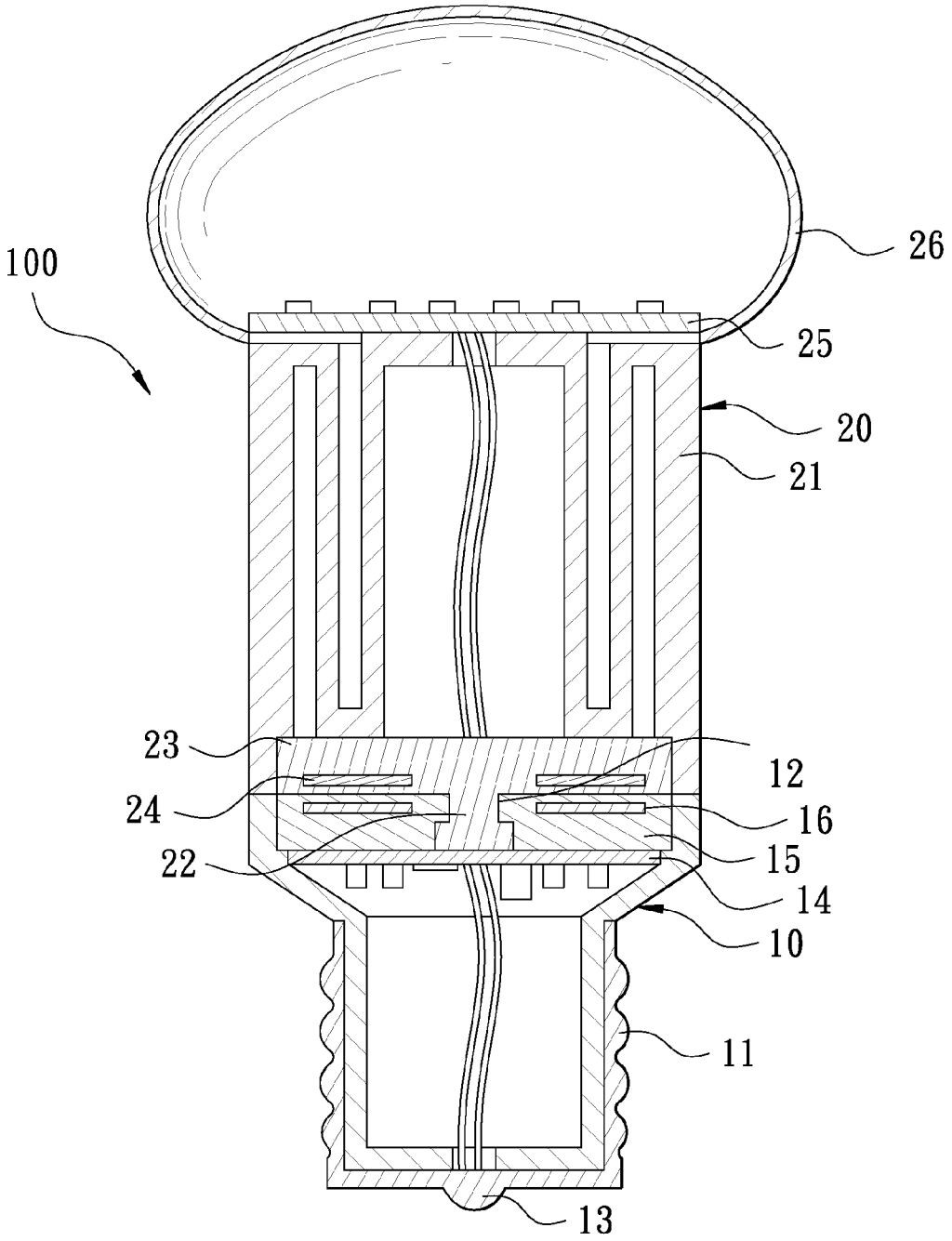
FIG. 4 is a cross-sectional view of the first preferred embodiment of the non-contact and non-disposable electric induction LED lamp in the present invention.

A non-contact and non-disposable electric induction LED lamp 100 in the present invention can be bulb-shaped, disk lamp-shaped or fluorescent lamp-shaped. A first preferred embodiment of a bulb-shaped non-contact and non-disposable electric induction LED lamp 100 in the present invention, as shown in FIGS. 2, 3 and 4, includes a power source 10 and a luminous-radiating unit 20 as main components combined together.

The power source portion 10 is formed with a base 11 and provided with a first combination member 12, which is an engage groove in this preferred embodiment. The base 11 has one side provided with an E27 electric adapter 13, and a power source module 14 electrically connected with the electric adapter 13 is installed on the base 11. The base 11 has another side set with a first electric induction plate 15 received therein with a first induction coil 16 and electrically connected with the power source module 14.

The luminous-radiating unit 20 is disposed with a heat-dissipating body 21 composed of multilayer circular radiating fins, and provided with a second combination portion 22 to be combined with the first combination portion 12 to assemble and fix the luminous-radiating portion 20 together with the power source 10. In this preferred embodiment, the second combination portion 22 is an engage projection so that the luminous-radiating unit 20 can be firmly fixed with the power source 10 in a mode of mutual engagement. Further, the heat-dissipating body 21 has one side that faces the base 1 provided with a second electric induction plate 23 having a second induction coil 24 installed therein, letting the second electric induction plate 23 of the luminous-radiating unit 20 correspond with the first electric induction plate 15 of the power source 10. An LED module 25 is mounted on the luminous-radiating unit 20 and electrically connected with the second electric induction plate 23, and the luminous-radiating unit 20 is further provided with a lamp shade 26 to be covered at the outer side of the LED module 25.

Figure 5:
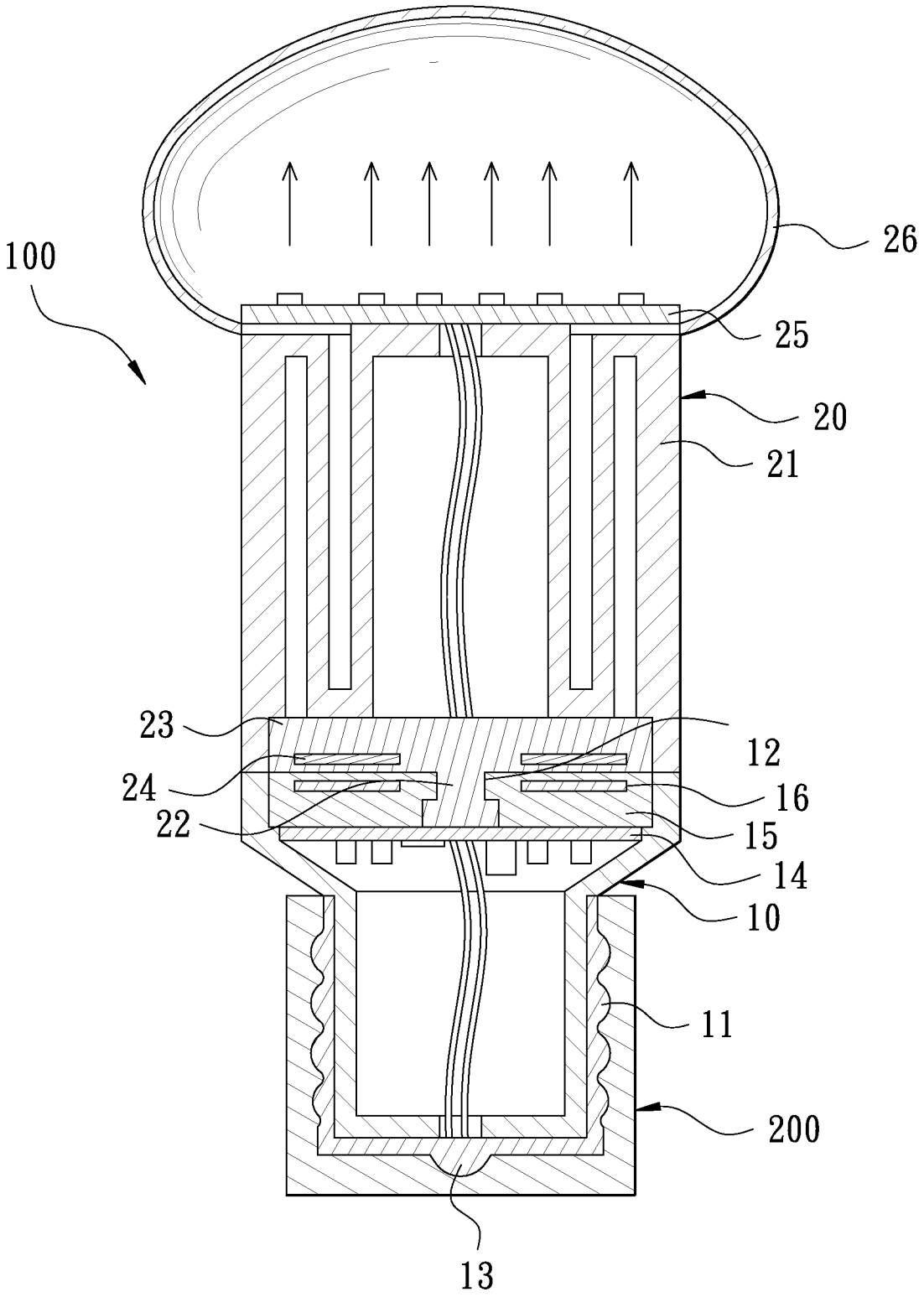
FIG. 5 is a cross-sectional view of the first preferred embodiment of the non-contact and non-disposable electric induction LED lamp in a using condition in the present invention.

In using, referring to FIG. 5, firstly, the luminous-radiating portion 20 is fixed with the power source 10 via mutual engagement of the first combination portion 12 with the second combination portion 22 to finish assembly of the non-contact and non-disposable electric induction LED lamp 100. Then, the electric adapter 13 is combined with an external electric socket 200 to enable the external alternating current offered by the electric socket 200 to be transmitted to the power source module 14 via the electric adapter 13. Simultaneously, the alternating current will be converted into direct current by the power source module 14 and transmitted to the first electric induction plate 15 to let the first induction coil 16 in the first electric induction plate 15 convert the direct current into magnetic force. Meanwhile, due to Faraday's electromagnetic induction principle, the second induction coil 24 in the second electric induction plate 23 will be excited by the magnetic force produced by the first induction coil 16 to generate electricity to be transmitted to the LED module 25 to drive the LED module 25 to emit light. By so designing, when certain component of the LED lamp 100 is damaged, only the power source 10 or the luminous-radiating unit 20 needs to be replaced singly, unnecessary to eliminate and replace the whole set of the LED lamp, able to lower selling price, enhance economic value and having an effect of environmental protection. In addition, the electricity of the power source 10 is transmitted to the luminous-radiating portion 20 by electromagnetic induction between the first electric induction plate 15 and the second electric induction plate 23, that is, transmission of electricity is carried out in a non-contact mode; therefore, no outer metallic contact needs to be provided to enable the power source 10 and the luminous-radiating portion 20 to be sealed completely, thus achieving waterproof and dustproof effects and facilitating the LED lamp 100 to be replaced.

Moreover, since the electricity of the power source 10 is transmitted to the luminous-radiating unit 20 in a non-contact mode; therefore, the luminous-radiating unit 20 can be replaced with a luminous-radiating unit of different specifications according to needs in use. For instance, a daylight-colored luminous-radiating unit 20 can be replaced with an electric bulb-colored luminous-radiating unit 20.

Figure 6:
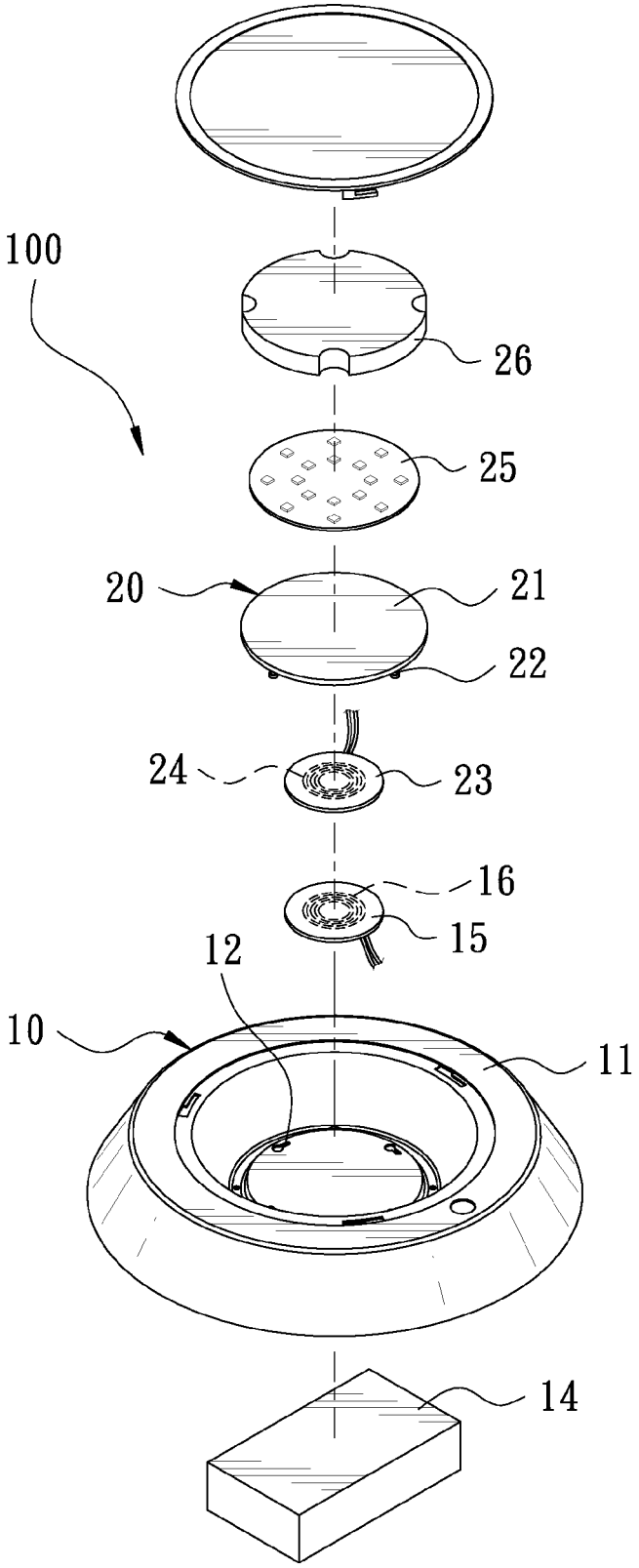
FIG. 6 is an exploded perspective view of a second preferred embodiment of a non-contact and non-disposable electric induction LED lamp in the present invention.
Figure 7:
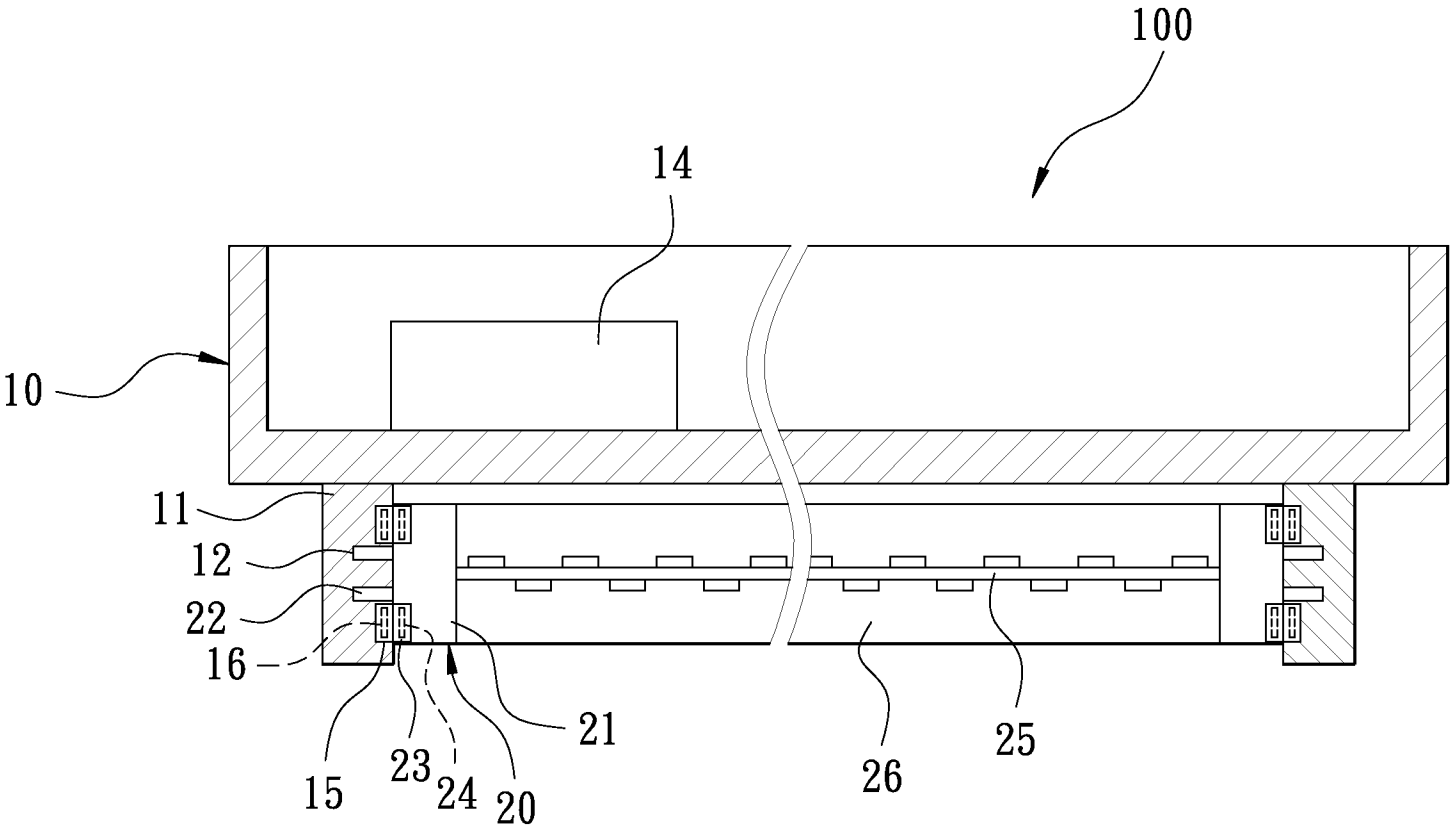
FIG. 7 is a cross-sectional view of a third preferred embodiment of a non-contact and non-disposable electric induction LED lamp in the present invention.

A second and a third preferred embodiments of a non-contact and non-disposable electric induction LED lamp 100, as shown in FIGS. 6 and 7, has almost the same structure as that described in the first preferred embodiment, except that the LED lamp 100 is disc lamp-shaped, as shown in FIG. 6 or fluorescent lamp-shaped, as shown in FIG. 7, and the first combination portion 12 is a fastening slot and the second combination portion 22 is a fastening block. Thus, the luminous-radiating unit 20 can be fixed with the power source 10 in a mode of clasping, able to attain the same effect as that described in the first preferred embodiment.

While the preferred embodiments of the invention have been described above, it will be recognized and understood that various modifications may be made therein and the appended claims are intended to cover all such modifications that may fall within the spirit and scope of the invention.

What is claimed is:

1. A non-contact and non-disposable electric induction LED lamp comprising:

a power source provided with a power source module;

said power source module electrically connected with a first electric induction plate;

a luminous-radiating unit assembled and fixed with said power source;

said luminous-radiating unit disposed with a second electric induction plate corresponding with said first electric induction plate;

said second electric induction plate electrically connected with an LED module;

said power source formed with a base for receiving both said power source module and said first electric induction plate;

said power source provided with a first combination portion, said luminous-radiating unit formed with a heat-dissipating body mounted thereon with said second electric induction plate and said LED module; and said luminous-radiating unit provided with a second combination portion to be combined with said first combination portion for fixedly assembling said luminous-radiating unit together with said power source.

2. The non-contact and non-disposable electric induction LED lamp as claimed in claim 1, wherein said first combination portion is a groove for an engagement, while said second combination portion is a projection for the engagement to enable said luminous-radiating unit to be firmly engaged with said power source.

3. The non-contact and non-disposable electric induction LED lamp as claimed in claim 1, wherein said heat-dissipating body is composed of multilayer circularly-arranged fins.

4. The non-contact and non-disposable electric induction LED lamp as claimed in claim 1, wherein said luminous-radiating unit is further provided with a lamp shade to be covered at an outer side of said LED module.

* * * * *